United States Patent [19]

Hechler et al.

[11] 4,441,390

[45] Apr. 10, 1984

[54] SHEET SEPARATING AND TRANSPORT APPARATUS

[75] Inventors: Hatto Hechler; Godber Petersen, both of Augsburg; Alfons Frick, Königsbrunn, all of Fed. Rep. of Germany

[73] Assignee: M.A.N.-Roland Druckmaschinen Aktiengesellschaft, Offenbach am Main, Fed. Rep. of Germany

[21] Appl. No.: 421,392

[22] Filed: Sep. 22, 1982

[30] Foreign Application Priority Data

Oct. 1, 1981 [DE] Fed. Rep. of Germany ..... 3139117

[51] Int. Cl.[3] ..... B65H 35/06

[52] U.S. Cl. ..... 83/154; 83/94; 83/152; 271/82; 271/270; 101/227

[58] Field of Search ..... 83/154, 94, 152; 271/270, 82; 101/226, 227, 240, 241

[56] References Cited

U.S. PATENT DOCUMENTS

| | | | |
|---|---|---|---|
| 452,025 | 5/1891 | Dear | 83/154 X |
| 3,675,522 | 7/1972 | Hull | 83/154 X |
| 3,808,971 | 5/1974 | Staamann | 101/226 X |
| 4,036,087 | 7/1977 | Braun | 83/154 X |
| 4,205,606 | 6/1980 | Jiruse | 101/240 |
| 4,285,513 | 8/1981 | Kwasnitza | 271/270 |
| 4,385,537 | 5/1983 | Wolf | 83/154 X |

OTHER PUBLICATIONS

"Der Tiefdruck" Published by Polygraph, p. 206, 1952.

*Primary Examiner*—Donald R. Schran

*Attorney, Agent, or Firm*—Frishauf, Holtz, Goodman & Woodward

[57] ABSTRACT

To permit continuous adjustment of separating rollers (10, 11) positioned downstream of cutter cylinders (3, 4) cutting sheets (7) from a continuous web (1) during operation of the machine, to adjust for different lengths of cut sheets, and accelerate the cut sheets to the circumferential speed of a gripper apparatus, the separating cylinders (10, 11) are mounted on a first carrier structure (38) which is longitudinally moveable independently of the drive therefore with respect to transport belts (8, 9) passing beneath the separating rollers, the adjustment spacing between the separating rollers being controllable, for example by compressed air cylinders (55). Drives, in order to reduce noise, preferably are by gear belts driven from the cutter cylinders, to provide for synchronized operation of the transport or conveyor belts, the separating cylinders (10, 11) and of subsequent transport apparatus, such as a gripper cylinder (12).

12 Claims, 4 Drawing Figures

1
2
2
4
16
18
15
3
5
17
19
6
20
21
23
7
8
9
22
24
25
39
II
27
57
II
34
26
58
36
11
10
12
31
33
37
30
38
10'
39
28
61
11'
35
45
8
27
44
29
40
43
14
45
46
13
39
45
47
48
49
50

SHEET SEPARATING AND TRANSPORT APPARATUS

The present invention relates to a sheet handling apparatus and more particularly to apparatus of this type suitable for use with web-type printing machines, for example offset printing machines, in which the webs are cut by cutter cylinders, and the then separated sheets are moved to a sheet handling apparatus, for example including a gripper-type cylinder.

BACKGROUND

When cutting sheets from a continuously moving web, it is important to match the tear-off speed, or removal or separating speed of the cut sheets to the subsequent handling apparatus. Customarily, the webs are fed at the linear speed which is less than the removal speed of the subsequent removal apparatus. This requires accelerating the sheets to the new, removal apparatus speed. It is also important to be able easily adjust the apparatus to handle sheets of different length being cut from the moving web.

In the book "Der Tiefdruck" published by Polygraph, 1952, page 206, a folding apparatus is shown in FIG. 187 which is provided to fold sheets which are cut from a continuous web. A continuously moving web is guided over a folding former, or folding triangle, and then moved through tension rollers to a pair of cutter cylinders, for cutting the folded web into folded sheets. The length of the folded sheets is determined by a forme cylinder positioned in advance-with respect to the direction of movement of the web-of the folding former. It is customary to operate folding apparatus of this type at a constant speed. The tension rollers which are placed in advance of the cutter cylinders may have circumferential speeds which are matched to the speed of the web. The speed of the web is always less than the linear speed with which the folding apparatus, and the cylinders and rollers thereof will operate. Consequently, the sheets which are cut from the web have to be accelerated. Since apparatus downstream of the cutters may work with grippers, sheets which are shorter than others have to be accelerated more. As the length of the sheets decreases, the acceleration has to be increased. The literature referred to shows a folding apparatus in which a removal or tear-off roller pair is used which is located downstream of the cutter apparatus within conveyer tapes or belts in order to guide the sheets. The sheets are accelerated at the instant of cutting them or separating them from the endless web to a speed corresponding to that of the subsequent removal apparatus, which may include the folder, by gripping or seizing the leading edge of the sheet to be cut by cams located on the tear-off rollers. The circumferential position of the cam discs on the tear-off rollers is moveable or changeable in order to be able to match the position of the cut sheet to the length thereof.

It has also been proposed-see page 100 of the above referred to text book-to utilize pivotable strips located on the tear-off of separating rollers which, when they meet the sheet, groups or grips the sheet. In order to accommodate sheets of different lengths, or to match apparatus of this type to different rotor reprinting machines of folding apparatus, it is necessary to so design the accelerating system that these pivoting strips can be circumferentially shifted about the circumference of the tear-off or separating rollers, since sheets of different lengths must be gripped at different instances of time with their leading edge. This, only, insures that the sheet to be cut is properly tensioned throughout its length at the time of the cutting, so that it can be accelerated without buckling or deformation.

It is not possible to change the cam location, or the location of the pivot strips in the known systems during operation; consequently, any adjustment or resetting is possible only when the machine is stopped. Cams which are to grip sheets may be subject to differential wear, and if the cams are located, axially staggered on the separating rollers, differently worn cams, or slightly skewed gripper-type pivoting strips will not uniformly grasp the sheet, resulting in skewed, or inclined pulling thereof. Use of cams has the additional disadvantage that the loading placed on the paper by the cams is very high due to the small surface area thereof, so that the specific surface loading may be so great that the substrate-if paper-may tear or be damaged; this, then, also leads to smear of printing subject matter due to the still-wet printing ink. It is thus necessary to an adjust the gripping cams or strips that they will engage only edge or marginal portions of the sheet, where no printed subject matter is contained. This, again, requires readjustment and resetting of the apparatus for specific jobs in accordance with the particular printed arrangement.

Use of separating tear-off rollers results in high noise levels during operation, since the engagement of the cams, and the pivoting or tipping of the pivot strips is noisy, often resulting in noise similar to hammering or impacts. The noise level of operation can be reduced by making the cams, or the pivot strips of high strength foam material. Unfortunately, however, the strength of such materials is insufficient for long time operation, and such foam structures, particularly of foam plastic materials require frequent replacement.

THE INVENTION

It is an object of the present invention to provide an apparatus in which tear-off rollers gently grip sheets, and which permits timed, snychronous operation with sheets of different lengths; and where, further, the thickness of the sheets, or a package of sheets should be adjustable, while preferably permitting adjustment of the position or timing of gripping of the leading edge of the sheet during operation of the machine.

Briefly, a carrier structure is provided on which one of the separating rollers is mounted, the carrier structure being longitudinally moveable with respect to the cutter rollers, so that the gripping position of the leading edge of sheets, cut by the cutter rollers or cylinders from a continuous web can be matched to the length of the cut sheets. The webs are fed to the cutter rollers by transport belts, the separating cylinder and the transport belt being operated at the speed of the cutter rollers. A second carrier structure, carrying a cooperating separating roller is secured on the first carrier structure, so that the longitudinal movement of the second carrier structure and hence of the second separating roller will be the same as that of the first; Additionally, however, the second carrier structure is moveable towards and away from the first, so that the thickness of the sheet to be gripped, or a stack of sheets can be appropriately adjusted and controlled. For low noise operation and positive drive, one of the separating rollers, preferably the upper one is driven from the cutter cylinders by a gear belt, or tooth belt, the two separating rollers, jointly, being driven by a further gear or tooth belt arrangement.

In accordance with a feature of the invention, a pair of transport belts are provided between which the sheets are transported and guided, the transport belts running beneath the tear-off rollers which are so positionable that they grip the leading edge of the sheet as they are being fed by the conveyor belts. In accordance with another feature of the invention, the conveyor belts are a plurality of conveyor strips or tapes which fit in circumferential grooves formed in the separating rollers which, in the portion between the grooves, may have elastic tires thereon, for example made of a rubber-type material.

The system has the advantage that sheets of substantially different lengths are always gripped with their leading edge, gently, and at the precise moment in which the cutting is effected between the cutter cylinders at the trailing edge thereof. Thus, the sheet is reliably held in stretched condition throughout its length, and since the circumferential speed of the cutter cylinders and of the separating cylinders is the same, the sheet is accelerated, while being stretched and taut, to the circumferential speed of subsequent removal apparatus, typically collection cylinders or cylinders having gripper systems, and operating at the higher removal speed. One run, each, of the conveyor belts is carrier at all times between the separating rollers. Thus, the belts will, as the still uncut web is supplied thereto, move the web forward to provide for precise guidance of the sheet between the conveyor belts on its path from the cutter cylinders, which will cut the trailing edge at precisely the time when the leading edge is being gripped by the separating roller or cylinder pair, the path then continuing to the removal apparatus, for example a gripper or collection cylinder.

DRAWINGS

Figure 1:
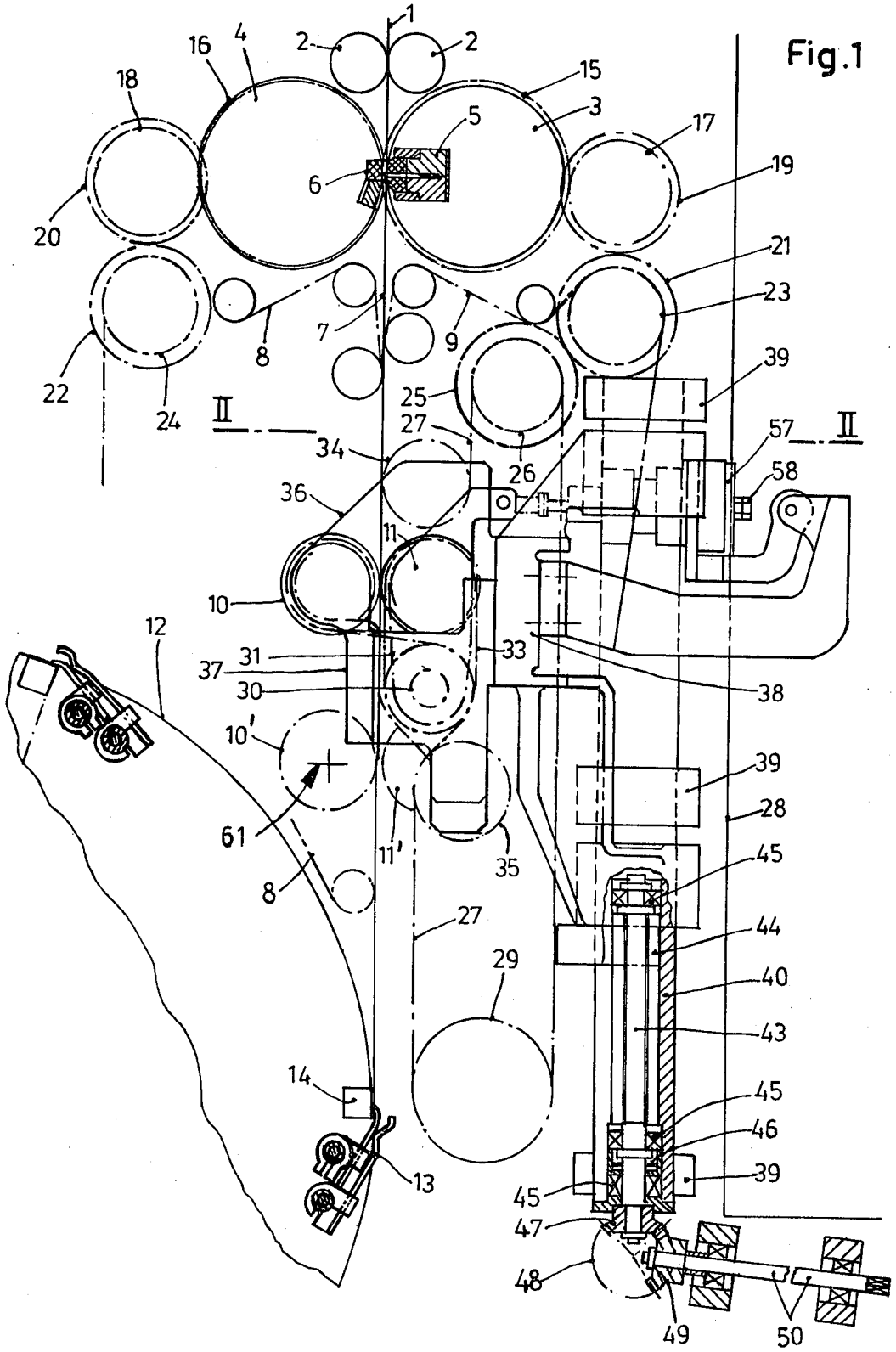
FIG. 1 is a schematic side view of the apparatus, showing the removal cylinders, and part of the apparatus in section.

A web 1, which is a continuous web and supplied, for example, from the printing machine is guided between a pair of feed rollers 2-see FIG. 1. The circumferential speed of the feed rollers 2 corresponds to the circumferential speed of a formecylinder, for example in a printing machine-not shown. The printed web 1 is cut into sheets by the cutter cylinder pair 3, 4. The length of the sheet is dependent on the diameter of the formecylinder. To effect cutting, the cutter cylinder pair 3, 4, has a cutter knife 5 which cooperates with a groove and counter element 6. The cutting apparatus itself is well-known and may be in accordance with any suitable construction. The sheets which are cut are received for transport by a conveyor belt system which includes an outer conveyor belt 8 and an inner conveyor belt 9, the belts running close to each other.

The belt system 8, 9 guides the substrate material 1, cut into sheets by the cutters 5, 6 to separating or tear-off rollers 10, 11, operating as a pair. The circumferential speed corresponds to the circumferential speed of the cutters cylinder pair 3, 4, and hence is higher than that of the feed rollers 2.

The separating rollers 10, 11 are capable of accelerating the cut sheets to the speed of the subsequent removal apparatus, for example a folding apparatus, which includes a collection cylinder 12 which has gripper systems 13 thereon. The collection or gripper cylinder 12 operates at a higher speed than the feed cylinders 2. Consequently, the sheets must be accelerated to be gripped in appropriately times relation by the gripper 13 of the collection or gripper cylinder 12. The grippers 13 cooperate with the usual gripper counter elements 14; grippers 13 and counters 14 may be of any suitable well-known construction.

Given a predetermined speed relation between the cylinder 12 and the feed rollers 2, acceleration of the cut sheets must be higher for sheets of shorter length.

The conveyor belts 8,9, are endless belts. They are driven from the cutter cylinder pair 3, 4, via gears 15, 16, 17, 18, 19, 20, 21, 22 and guide rollers 23, 24 coupled to the gears 21, 22, respectively.

The belt 9 is partially guided about a portion of the gripper cylinder 12 and returned to the guide roller 23; the belt 8 is returned to the guide roller 24 already in advance of the gripper cylinder. The return path is not shown in detail, nor are suitable deflection rollers within the return path, since any suitable and standard construction may be used, and a detail showing will unduly complicate the drawing.

The separating roller 10 is driven over gears 21 and 25 and by a double tooth gear belt 27, that is, a gear belt carrying gear teeth on both sides thereof. The gear belt 27 is guided over a fixed deflection roller 29, carried in a wall of the frame 28 of the apparatus, and guides the gear 27 to the sprocket 26. The gear belt 27 also drives a gear 31, secured to a shaft 30. Shaft 30 additionally has sprocket 32 secured thereto, which is engaged with a gear belt 33, driving the separating roller 11-see the left side of FIG. 3 and FIG. 1.

Figure 2:
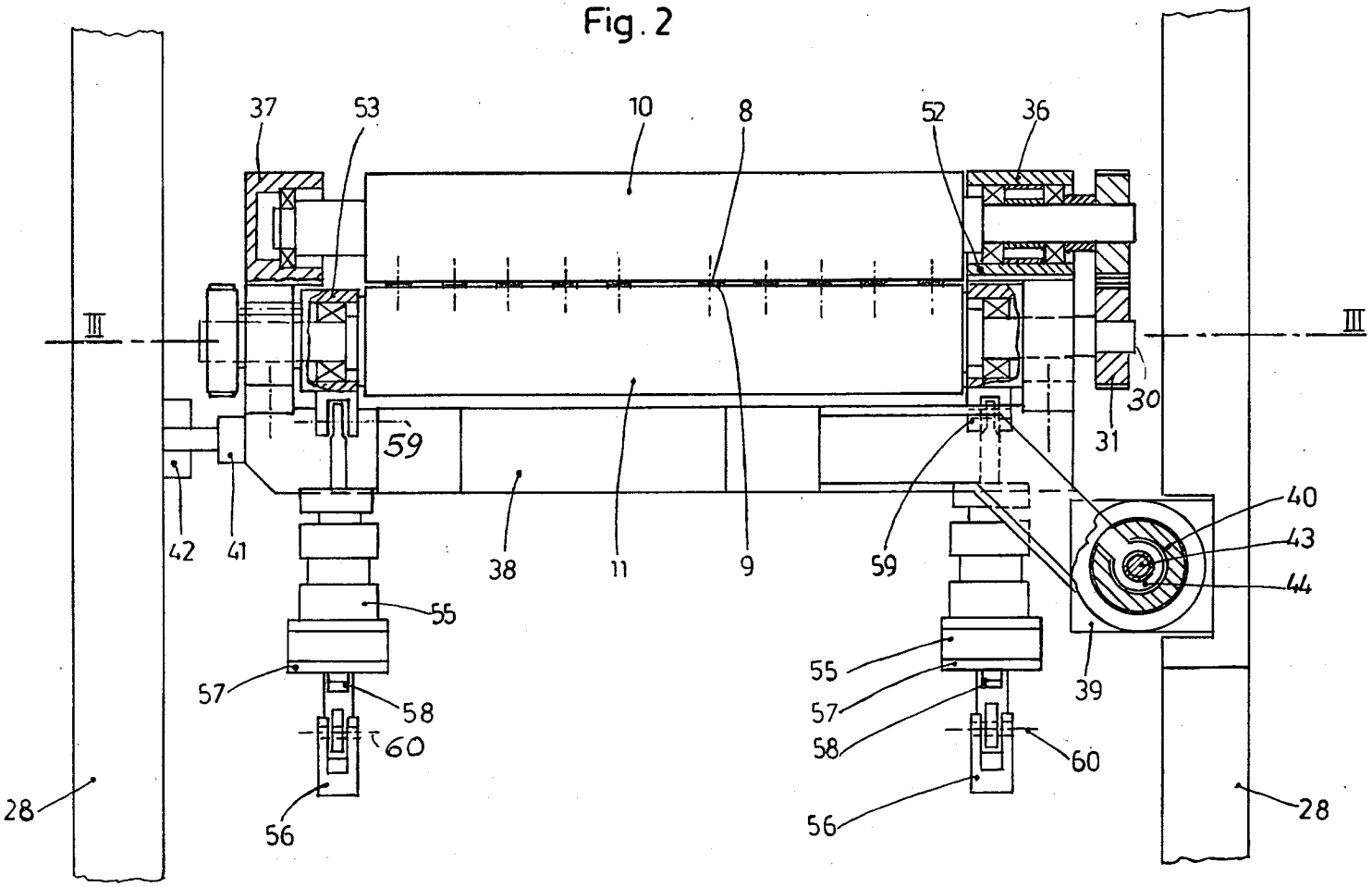
FIG. 2 is an end view of the apparatus taken along line II—II, partly in section, and omitting all portions not necessary for an understanding of the invention to simply the drawing.

The separating roller 10, and shaft 30, as well as the deflection rollers 34, 35 for the gear belt 37 are journaled in housings 36, 37-see FIGS. 1 and 2-which, in turn, are secured to a support carrier 38. The carrier 38 surrounds a guide tube 40-see FIG. 2-which is secured to the right wall of the frame 28 by a holder 39. Guide tube 40, thus, carries the entire apparatus and permits up-and-down movement of the carrier 40 in the direction to, and away from the carrier cylinders 3, 4. To prevent rotation of the carrier 38, a guide pin 41 is secured thereto which is slideable in a guide track 42 secured to the left wall of the frame 28-see FIG. 2.

The construction of the adjustment and positioning apparatus is best seen in FIGS. 1 and 2. An Acme thread spindle 43 is provided, cooperating with a positioning nut secured to the carrier 38. Upon rotation of the spindle 43, carrier 38 is moved up and down, and thus moves the position of the separating rollers 10 secured thereto. The spindle 43 is journaled in bearings 45 and in axial bearing 46, positioned within the guide tube 40. As best seen in FIG. 1, a suitable rotation by an operating element, for example a hand crank, or a servo motor, rotating a positioning shaft 50 can transmit rotation to the spindle 43 via gear arrangement 47, 48, 49, including for example, spur gears. Remote control is a preferred embodiment, by coupling, for example, a servo motor to spindle 50 or to the gear 48, with spindle 50 then being available for additional hand control or adjustment.

The inner separating roller or cylinder 11 preferably is secured in swing bearings 51 in housings 52 and 53. Housing 52, 53 are rotatably secured in bearings 54 on shaft 30. This permits moving the separating roller 11 by fluid cylinders 50-FIGS. 2,3-for example compressed air or other pneumatically operated cylinders to move the roller 11 towards and away from the roller 10. Other systems of charging the position of the roller 11 may be used. A predetermined and clearly defined and calibrated position of roller 11 with respect to roller 10 can thus be controlled and commanded, the distance between the rollers being related to the thickness of the sheet to be handled, or, for example, the thickness of a stack or package of such sheets. Pivoting movement of the roller 11 is preferred, which is so moved that the roller 11, with reference to the center of the shaft 30, is moved about an arc so that the driving belt 33 will always be properly tensioned and need not be readjusted. The elastic drive by using a gear belt 33, coupled with the pivotable positioning of the roller 11 permits ready adjustment of the roller 11 in a preferred and excellently suitable manner. The pneumatic cylinders 55 apply a suitable engagement force to the roller 11, for example by using auxiliary compressed air amplifiers (not shown) and well-known in the art, so that the cylinders 55 will provide the proper and controlled engagement pressure.

The cylinders 55 are secured to the carrier 38 over holders 56. An adjustment scale 57-FIG. 2-cooperates with an abutment or engagement element so that the spacing to the cooperating roller 10 can be adjusted. Thus, the nip or the width of the gap between the rollers 10, 11, or, respectively, the belts 9, 8 running beneath the rollers can be appropriately matched to the thickness of the sheets 7, or the package of sheets, respectively. The selected positioning and adjustment can be read off the scale 57, and set to prevent change by a counter nut 58, secured to the piston rod of the pneumatic cylinder 55, not further specifically identified, so that the pneumatic cylinder is provided with a limiting abutment. The pneumatic cylinders 55 are secured to bolts 59, and 60, respectively, and thus permits pivoting and twisting by use of moveable joints.

Operation-with specific reference to FIGS. 1 and 2; The pair of cutter cylinders 3, 4, the conveyor belts 8, 9, the separating or tear-off rollers 10, 11 and the gripper cylinder 12 all operate with the same linear speed. The feed rollers 2, and hence the web 1 is being supplied with a variable speed which, in any event, is less than the linear speed of the cutter cylinders and the transport and cylinder apparatus operating at the same speed. The sheet 7, cut from the web 1 is accelerated at its trailing end in the moment in which it is cut between the pair of cutter cylinders. At the same time, the sheet 7 is gripped at its front or leading edge by the separating rollers or cylinders 10, 11, and by the bolts 8, 9, running therealong, respectively. This gripping is precise and gentle, and thus advantageously providing for keeping the cut sheet 7 taut throughout its length, and to accelerate the cut sheet in this same taut manner. In accordance with a feature of the invention, the rollers or cylinders 10, 11 can be adjusted with respect to their distance from the cutter cylinder pair 3, 4, in such a manner, that their axial position to the center of rotation of the cutter cylinders 3, 4, precisely matches the length of the sheet 7 to be cut from the web 1. Thus, and independently of the length of the sheet, any sheet 7 which is cut is accelerated at its leading end in the same instant as it is cut at the trailing end. This retains the sheet-as described-in taut, stretched unbuckled condition, and can be supplied with the appropriate linear speed to the gripper cylinder 12 and to the gripper 13 thereon at the circumferential speed of the gripper cylinder 12.

The rollers or cylinders 10, 11 or, more precisely, the belts 8, 9 running therealong-see FIG. 2-form a fixed pressure point, the pressure of which is controllable by the positioning adjustment system formed by the pneumatic cylinders 55. The gap or nip between the rollers 10, 11, and hence between the belts 8, 9 can be changed at the engagement point by suitable setting of the abutment or stop 58 by turning a ring carrying adjustment scale 57 which, for example, cooperates with a threaded spindle on the stop 58, so that the thickness of the material to be cut and supplied to the cylinder 12, and the spacing between the rollers 10, 11, corresponding to that of sheets or stacks or packages of sheets can be suitably matched.

Longitudinal shift of the rollers 10, 11 is schematically shown in FIG. 1, in which the rollers 10 are again shown at a position 10', in chain dotted lines. Moving the rollers to this position indicated at 61 permits handling sheets of substantially greater length than the sheet which would be handled if the apparatus is adjusted as shown in full line position. This larger sheet would result if, for example, a forme cylinder with a larger diameter is used. Position 61 only shows the position of the separating rollers, with prime notation, at 10', 11' in chain dotted representation. Other components have not been drawn in in shifted positions for clarity. Desirably, moving the rollers 10, 11 changes also the position of the entire mechanism which controls the thickness of the gap, or the nip between the rollers, so that no change of the gap or nip adjustment between the rollers will result if only the length of the sheet is to be changed. The superimposed position of the deflection roller 34, 35 insure that the tooth belt drive for the roller 10 does not change in length either, so that no readjustment of the belt drive need be made even though the longitudinal position of the roller 10, 11 is changed, for example to the position 61 at 10', 11'.

Figure 3:
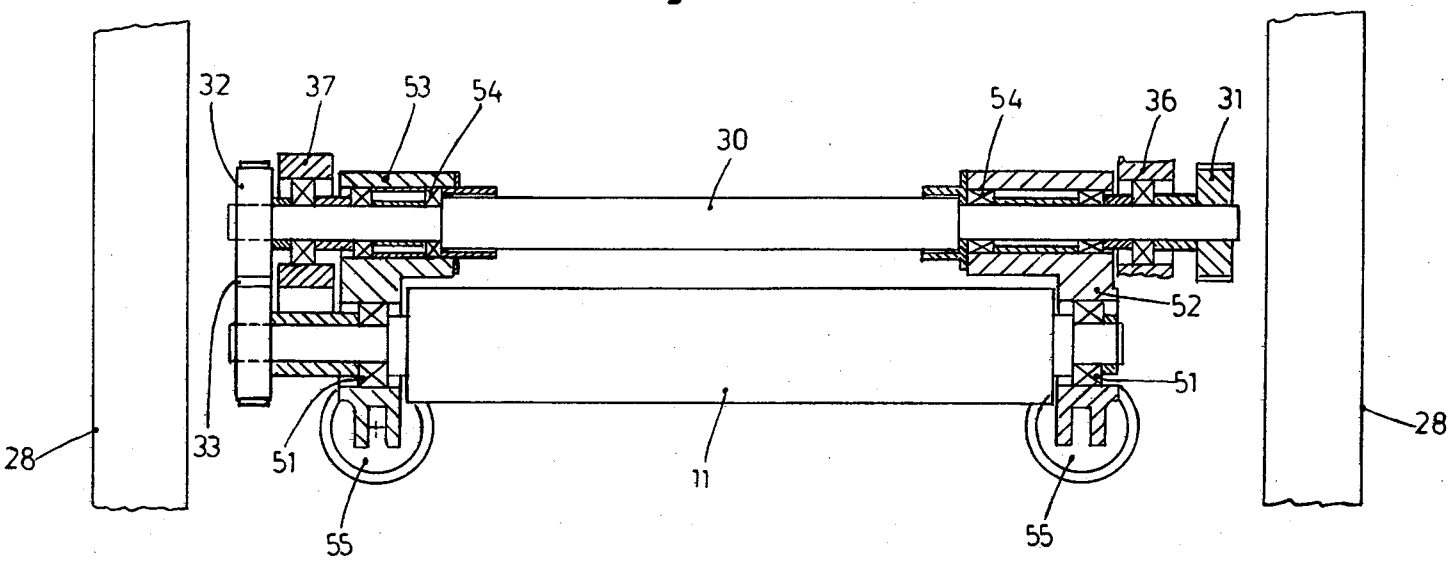
FIG. 3 is a section along line III—III of FIG. 2, in which the separating rollers have circumferential tires to receive the transport belts in grooves therebetween, the view being partly in section.
Figure 4:
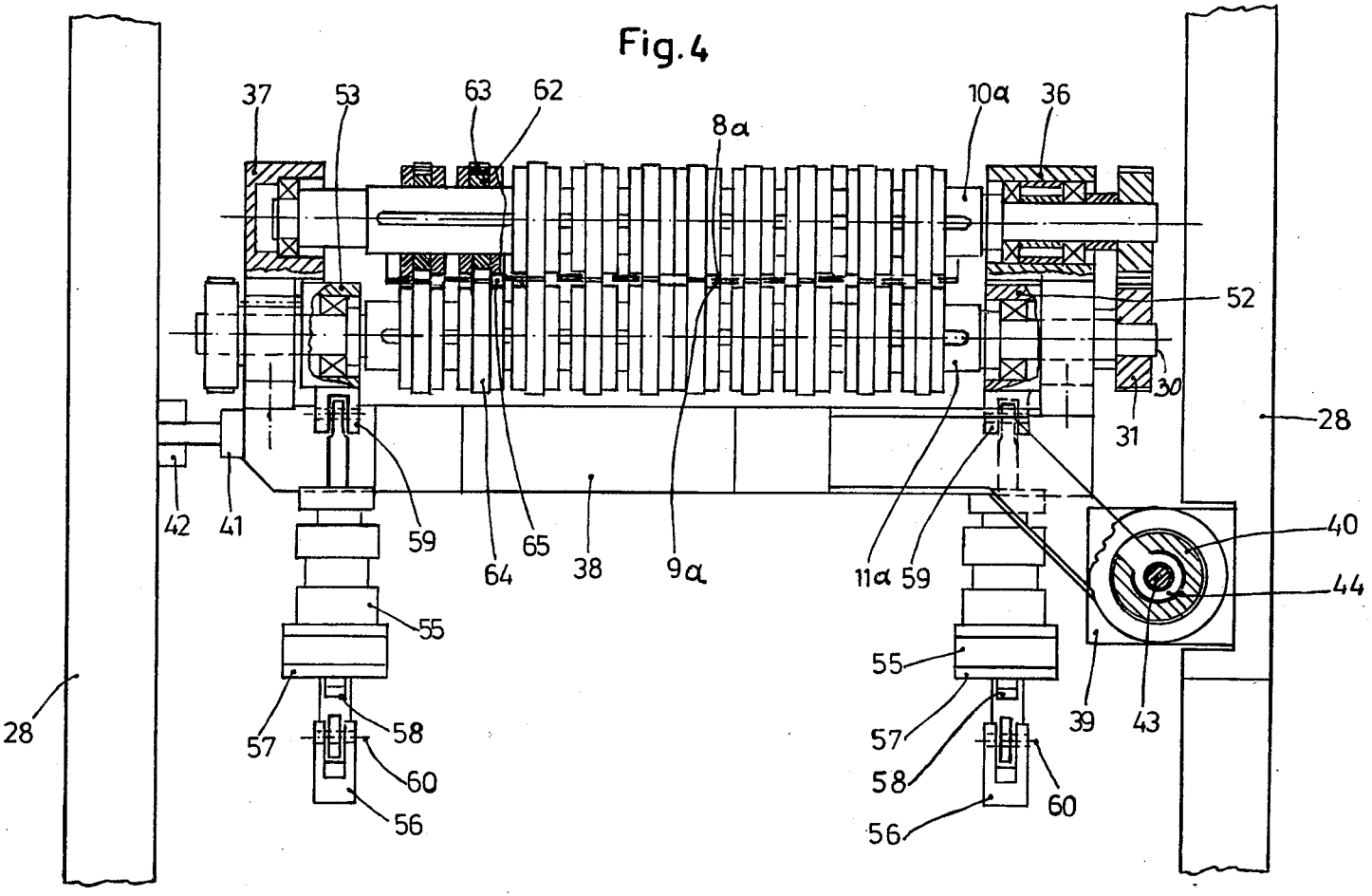

Embodiment of FIG. 4: The overall operation, and construction is similar to that of the apparatus described in connection with FIGS. 1-3, and the same reference numerals have been used for similar elements. The difference is the particular construction of the rollers 10, 11.

The rollers 10, 11 are built up of steel discs 62 which carry elastic rings, for example of a rubbery material such as vulkollan. These elastic rings, which may also be plastic or similar elastomers 63, 64 on the roller **10*a*, 11*a* define, between them in axial direction, grooves 65 through which tape-like conveyor belts 8*a*, 9*a* can pass. The tape-type conveyor belts 8*a*, 9*a* are then used only to guide the cut sheets 7; the timed gripping of the leading edge of the cut sheets is effected by the rings 63, 64 on the rollers 10*a*, 11*a***.

Adjustment of the nip between the elastic tires 63, 64 of the rollers **10*a*, 11*a* is done in the same way, and by the same means as described in connection with the rollers 10, 11, FIGS. 1-3**.

Various changes and modifications may be made in features described in connection with any one of the embodiments may be used with any of the others, within the scope of the inventive concept.

We claim:

1. Sheet severing, separating and transport apparatus, particularly for use with a printing machine having a frame (28);

feed roller means (2) for feeding a web of a substrate (1);

a pair of cutter cylinders (3, 4) cutting the web of substrate being fed thereto by said feed roller means into individual sheets (7);

a gripper cylinder (12, 13, 14) for receiving the cut sheets, and operating at the circumferential speed higher than the speed of the feeding roller means (2);

a first and a second separating roller (10,11; 10*a*,11*a*);

belt transport means (8,9; 8*a*, 9*a*) to receive the cut sheets from said cutter cylinders and to deliver them to the gripper cylinder;

and means synchronizing operation of the cutter cylinders, the separating rollers and the belt transport means for timed delivery of cut sheets to said gripper cylinder, and adjustable for different lengths of the cut sheets comprising, in accordance with the invention a first carrier structure (38) longitudinally-with respect to the direction of transport of the sheets by said belt transport means (8, 9)-moveably mounted in the frame (28);

the first separating roller (10, 10*a*) being secured to the carrier for longitudinal movement therewith;

a second carrier structure (52, 53);

the second separating roller (11) being secured to said second carrier structure;

a shaft (32) rotatably secured in the second carrier structure and having an axis of rotation parallel to the first separating roller (10);

positioning means (55) adjustably securing the second carrier structure (52, 53) to the first carrier structure to adjust the spacing between the first and second separating rollers;

a gear belt (33) drivingly connecting the first and second separating rollers;

the belt transport means including a first endless transport belt means (8,8*a*) being passed with one run adjacent the circumference of the first separating roller (10) and at one side of the substrate and then the cut sheet (1, 7), and a second endless transport belt means (9, 9*a*) being passed with one run adjacent the circumference of the second separating roller (11) and at the other side of the substrate;

and positive drive means (27) positively driving one (10) of the separating rollers from the cutter cylinders (3, 4) with the same circumferential speed as the cutter cylinders; and belt drive means for driving the endless belt means (8, 8*a*, 9, 9*a*) at essentially the same linear speed as the cutter cylinders, so that the sheets (7) cut by the cutter cylinders (3, 4) from the web of substrate (1) will be transported to the separating rollers (10, 10*a*, 11, 11*a*) and gripped with the leading edge of the sheet by the separating rollers upon arival thereat, and accelerated to the speed of the cutter cylinders and hence of the gripper cylinder (12, 13, 14) while being maintained in stretched, taut, condition by the endless belt means, longitudinal movement of the first carrier structure (38) carrying said separating rollers (10, 11, 10*a*, 11*a*) along the length of the paths of the belt transport means permitting adjustment of the apparatus to accommodate sheets (7) of various lengths.

2. Apparatus according to claim 1 wherein (FIG. 2) the endless transport belt means (8, 9) are passed beneath the circumferences of the separating rollers (10, 11), sheets (7) being transported by said belt means being gripped by pressure exerted by the separating rollers on the belts as they are passing beneath the separating rollers.

3. Apparatus according to claim 1 wherein (FIG. 4) the separating rollers (10*a*, 11*a*) are formed with circumferential grooves, and the endless belt means (8*a*, 9*a*) are fitted within said grooves, the ridges between said grooves of the separating rollers gripping the sheets (7) being transported to said separating rollers.

4. Apparatus according to claim 3 wherein the separating rollers comprise axially stacked discs (62) and circumferentially positioned tires (63, 64) secured to said discs, and spacer elements located between said discs of lesser diameter than the outer diameter of the tires, the endless belt means passing in the grooves defined by said spacer elements.

5. Apparatus according to claim 1 wherein the positive drive means (27) for positively driving one (10) of the separating rollers comprises an endless gear belt (27) driving the first separating roller.

6. Apparatus according to claim 5 further comprising a housing structure (36, 37) secured to the first carrier structure (52, 53);

at least one deflection roller (34, 35) located on said housing structure, said gear belt being passed over said at least one deflection roller and in driving connection engagement with at least one (10) of said separating rollers.

7. Apparatus according to claim 6 wherein said gear belt is in driving engagement with the first separating roller (10), and two deflection rollers (34, 35) are provided, one (34) being located behind-in the direction of sheet transport-the first separating roller (10) and the gear belt means being drivingly engaged with the first and second separating rollers (10, 11).

8. Apparatus according to claim 7 further including a drive train (15, 17, 21, 25) coupling the gear belt to one (3) of the cutter cylinders (3, 4).

9. Apparatus according to claim 1 further including a guide track (42) formed in one side of the frame (28);

a guide in (41) secured to said first carrier structure (38) being located in said guide track;

a longitudinally adjustable positioning mechanism (42–50) coupling the other side of the frame (28) and said first carrier structure (38) including a guide tube (80) secured to the carrier structure and a holder element (39) therefore secured to the frame.

10. Apparatus according to claim 9 wherein the positioning mechanism includes a nut-threaded spindle mechanism.

11. Apparatus according to claim 1 wherein the positioning means comprises a fluid operated piston-cylinder arrangement (55).

12. Apparatus according to claim 11 further including adjustable abutment or stop means (57, 58) for adjusting the spacing between facing surfaces of the separating rollers (10, 11, 10*a*, 11*a*).

* * * * *